US010217562B2

(12) United States Patent
Yamagata et al.

(10) Patent No.: US 10,217,562 B2
(45) Date of Patent: Feb. 26, 2019

(54) METHOD FOR MANUFACTURING R-T-B BASED SINTERED MAGNET

(71) Applicant: HITACHI METALS, LTD., Minato-ku, Tokyo (JP)

(72) Inventors: Ryouichi Yamagata, Mishima-gun (JP); Futoshi Kuniyoshi, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/528,781

(22) PCT Filed: Feb. 23, 2016

(86) PCT No.: PCT/JP2016/055167
§ 371 (c)(1),
(2) Date: May 23, 2017

(87) PCT Pub. No.: WO2016/136705
PCT Pub. Date: Sep. 1, 2016

(65) Prior Publication Data

US 2017/0323722 A1 Nov. 9, 2017

(30) Foreign Application Priority Data

Feb. 27, 2015 (JP) ..... 2015-037790
Sep. 28, 2015 (JP) ..... 2015-189773

(51) Int. Cl.
*H01F 41/02* (2006.01)
*H01F 7/02* (2006.01)
(Continued)

(52) U.S. Cl.
CPC ..... *H01F 41/0253* (2013.01); *B22F 3/06* (2013.01); *B22F 3/24* (2013.01); *B22F 9/04* (2013.01);
(Continued)

(58) Field of Classification Search
None
See application file for complete search history.

(56) References Cited

U.S. PATENT DOCUMENTS 9,368,276 B2 * 6/2016 Kuniyoshi ..... B22F 3/24
9,415,444 B2 * 8/2016 Kuniyoshi ..... B22F 3/24
(Continued)

FOREIGN PATENT DOCUMENTS

JP WO2012/008426 A1 * 1/2012
JP 2012-169436 A 9/2012
(Continued)

*Primary Examiner* — Xiaowei Su
(74) *Attorney, Agent, or Firm* — Keating & Bennett, LLP

(57) ABSTRACT

A method for producing a sintered R-T-B based magnet of this disclosure includes the steps of preparing a plurality of sintered R-T-B based magnet bodies (R is at least one of rare earth elements and necessarily contains Nd and/or Pr; and T is at least one of transition metals and necessarily contains Fe); preparing a plurality of alloy powder particles having a size of 90 μm or less and containing a heavy rare earth element RH (the heavy rare earth RH is Tb and/or Dy) at a content of 20 mass % or greater and 80 mass % or less; loading the plurality of sintered R-T-B based magnet bodies and the plurality of alloy powder particles of a ratio of 2% by weight or greater and 15% by weight or less with respect to the plurality of sintered R-T-B based magnet bodies into a process chamber; and heating, while rotating and/or swinging, the process chamber to move the sintered R-T-B based magnet bodies and the alloy powder particles continuously or intermittently to perform an RH supply and diffusion process.

12 Claims, 2 Drawing Sheets

(51) Int. Cl.

| | |
|---|---|
| ***B22F 3/06*** | (2006.01) |
| ***B22F 3/24*** | (2006.01) |
| ***B22F 9/04*** | (2006.01) |
| ***C22C 30/02*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |
| ***H01F 1/055*** | (2006.01) |
| *H01F 1/057* | (2006.01) |

(52) U.S. Cl.

CPC ..... *C22C 30/02* (2013.01); *C22C 38/001* (2013.01); *C22C 38/002* (2013.01); *C22C 38/005* (2013.01); *C22C 38/06* (2013.01); *C22C 38/10* (2013.01); *C22C 38/16* (2013.01); *H01F 1/0551* (2013.01); *H01F 1/0557* (2013.01); *H01F 41/0293* (2013.01); *B22F 2003/248* (2013.01); *B22F 2009/049* (2013.01); *C22C 2202/02* (2013.01); *H01F 1/0577* (2013.01)

(56) References Cited

U.S. PATENT DOCUMENTS

| | | | | |
|---|---|---|---|---|
| 9,478,332 | B2 * | 10/2016 | Kuniyoshi | C22C 30/00 |
| 9,613,748 | B2 * | 4/2017 | Kuniyoshi | H01F 41/005 |
| 2005/0183791 | A1 * | 8/2005 | Hidaka | C22C 1/0441 148/103 |
| 2008/0245442 | A1 | 10/2008 | Nakamura et al. | |
| 2008/0286595 | A1 | 11/2008 | Yoshimura et al. | |
| 2010/0282371 | A1 * | 11/2010 | Sagawa | H01F 1/0557 148/302 |
| 2012/0112863 | A1 | 5/2012 | Kuniyoshi | |
| 2013/0171342 | A1 | 7/2013 | Kuniyoshi | |

FOREIGN PATENT DOCUMENTS

| | | | |
|---|---|---|---|
| JP | WO2013/002170 | A1 * | 1/2013 |
| JP | 2014-072259 | A | 4/2014 |
| WO | 2006/043348 | A1 | 4/2006 |
| WO | 2007/102391 | A1 | 9/2007 |
| WO | 2011/007758 | A1 | 1/2011 |
| WO | 2012/043692 | A1 | 4/2012 |

* cited by examiner

METHOD FOR MANUFACTURING R-T-B BASED SINTERED MAGNET

TECHNICAL FIELD

The present invention relates to a method for producing a sintered R-T-B based magnet.

BACKGROUND ART

A sintered R-T-B based magnet is known as a permanent magnet with the highest performance. R is at least one of rare earth elements, and necessarily contains Nd and/or Pr. T is at least one of transition metals, and necessarily contains Fe. A sintered R-T-B based magnet is used for various uses including various motors such as a voice coil motor (VCM) of a hard disc drive, a motor for an electric vehicle (encompassing EV, HV and PHV), a motor for an industrial device and the like, and also electric and electronic home appliances.

A sintered R-T-B based magnet includes a main phase formed of a compound having an $R_2T_{14}B$-type crystal structure and a grain boundary phase located at a grain boundary of the main phase. The $R_2T_{14}B$ phase as the main phase is a ferromagnetic phase and mainly contributes to a magnetization function of the sintered R-T-B based magnet.

R contained in the $R_2T_{14}B$ phase, which is a main phase of the sintered R-T-B based magnet, contains a light rare earth element RL (mainly Nd and/or Pt). It is known that replacement of a part of the light rare earth element RL with a heavy rare earth element RH (mainly Dy and/or Tb) improves the coercivity $H_{cJ}$ (hereinafter, may be referred to simply as "$H_{cJ}$"). Namely, the heavy rare earth element RH needs to be used in a large amount in order to improve $H_{cJ}$.

However, the replacement of the light rare earth element RL in the $R_2T_{14}B$ phase in the sintered R-T-B based magnet with the heavy rare earth element RH, although improving $H_{cJ}$, decreases the remanence $B_r$ (hereinafter, may be referred to simply as "$B_r$"). Therefore, it is demanded to improve $H_{cJ}$ with use of a minimum possible amount of the heavy rare earth element RH so that $B_r$ is not decreased. The use of the heavy rare earth element RH is demanded to be decreased also because the heavy rare earth element RH is a rare metal.

According to a recently proposed method for improving $H_{cJ}$ of the sintered R-T-B based magnet, a heavy rare earth element RH such as Dy, Tb or the like is supplied to a surface of the sintered R-T-B based magnet and diffused to the inside of the magnet. Thus, $H_{cJ}$ is improved while the decrease in $B_r$ is suppressed.

According to a method described in Patent Document No. 1, a sintered body and a bulk body containing a heavy rare earth element RH are spaced apart from each other while a net or the like formed of Nb is present therebetween, and the sintered body and the bulk body are heated to a predetermined temperature. In this manner, the heavy rare earth element RH is supplied from the bulk body to a surface of the sintered body while being diffused to the inside of the sintered body.

According to a method described in Patent Document No. 2, powder containing at least one of Dy and Tb is put on a surface of a sintered body and heated to a temperature lower than the sintering temperature, so that at least one of Dy and Tb is diffused into the sintered body from the powder.

According to a method described in Patent Document No. 3, a plurality of sintered R-T-B based magnets and a plurality of RH diffusion sources containing a heavy rare earth element RH are loaded into a processing chamber such that the sintered R-T-B based magnets and the RH diffusion sources are movable with respect to each other and contactable with each other, and are heated in the processing chamber while being moved continuously or intermittently. In this manner, the heavy rare earth element RH is supplied from the RH diffusion sources to a surface of the sintered R-T-B based magnets while being diffused to the inside of the sintered magnets.

CITATION LIST

Patent Literature

Patent Document No. 1: PCT International Application Publication No. WO2007/102391

Patent Document No. 2: PCT International Application Publication No. WO2006/043348

Patent Document No. 3: PCT International Application Publication No. WO2011/007758

SUMMARY OF INVENTION

Technical Problem

The method described in each of Patent Documents Nos. 1 through 3 allows $H_{cJ}$ to be improved while suppressing $B_r$ from being decreased. However, the method described in Patent Document No. 1 requires the sintered body and the bulk body containing the heavy rare earth element RH to be spaced apart from each other. Therefore, the step of arranging the sintered body and the bulk body is time-consuming. The method described in Patent Document No. 2 requires a long time for the step of applying a slurry containing Dy- or Tb-containing powder dispersed in a solvent to the sintered body. By contrast, according to the method described in Patent Document No. 3, the RH diffusion sources and the sintered R-T-B based magnets are loaded into the processing chamber and moved continuously or intermittently. Specifically, a process chamber is rotated and/or swung. Therefore, the sintered R-T-B based magnets and the RH diffusion sources do not need to be spaced apart from each other. In addition, the heavy rare earth element does not need to be dispersed in the solvent, or a slurry containing the heavy rare earth element does not need to be applied to the sintered body. The method described in Patent Document No. 3 allows the heavy rare earth element RH to be supplied from the RH diffusion source to the sintered R-T-B based magnet while being diffused to the inside of the sintered body.

The method described in Patent Document No. 3 improves $H_{cJ}$ while suppressing $B_r$ from being decreased relatively easily. However, there is a case where the degree of improvement in $H_{cJ}$ is changed, and as a result, a high value of $H_{cJ}$ is not obtained stably.

This disclosure provides a new method for producing a sintered R-T-B based magnet.

Solution to Problem

A method for producing a sintered R-T-B based magnet of this disclosure, in an embodiment, includes the steps of preparing a plurality of sintered R-T-B based magnet bodies (R is at least one of rare earth elements and necessarily contains Nd and/or Pr; and T is at least one of transition metals and necessarily contains Fe); preparing a plurality of alloy powder particles having a size of 90 μm or less and containing a heavy rare earth element RH (the heavy rare earth RH is Tb and/or Dy) at a content of 20 mass % or greater and 80 mass % or less; loading the plurality of sintered R-T-B based magnet bodies and the plurality of alloy powder particles of a ratio of 2% by weight or greater and 15% by weight or less with respect to the plurality of sintered R-T-B based magnet bodies into a process chamber; and heating, while rotating and/or swinging, the process chamber to move the sintered R-T-B based magnet bodies and the alloy powder particles continuously or intermittently to perform an RH supply and diffusion process.

In an embodiment, the plurality of sintered R-T-B based magnet bodies necessarily contain Nd.

In an embodiment, the method further includes the step of loading a plurality of stirring aid members into the process chamber.

In an embodiment, during the RH supply and diffusion process, only the plurality of sintered R-T-B based magnet bodies, the plurality of alloy powder particles and the plurality of stirring aid members are contained as solids in the process chamber.

In an embodiment, the plurality of alloy powder particles each have a size of 38 μm or greater and 75 μm or less.

In an embodiment, the plurality of alloy powder particles each have a size of 38 μm or greater and 63 μm or less.

In an embodiment, the plurality of alloy powder particles is loaded into the process chamber at a ratio of 3% by weight or greater and 7% by weight or less with respect to the plurality of sintered R-T-B based magnet bodies.

In an embodiment, the plurality of alloy powder particles at least partially contain alloy powder particles having a new surface exposed.

In an embodiment, the plurality of alloy powder particles contain the heavy rare earth element RH at a content of 35 mass % or greater and 65 mass % or less.

In an embodiment, the plurality of alloy powder particles contain the heavy rare earth element RH at a content of 40 mass % or greater and 60 mass % or less.

In an embodiment, the heavy rare earth element RH is Tb.

In an embodiment, the plurality of alloy powder particles are produced by performing hydrogen pulverization on an alloy containing a heavy rare earth element RH (the heavy rare earth element RH is Tb and/or Dy) at a content of 35mass % or greater and 50 mass % or less; and in a dehydrogenation step of the hydrogen pulverization, the alloy is heated to a temperature of 400° C. or higher and 550° C. or lower.

DESCRIPTION OF EMBODIMENTS

Figure 1:
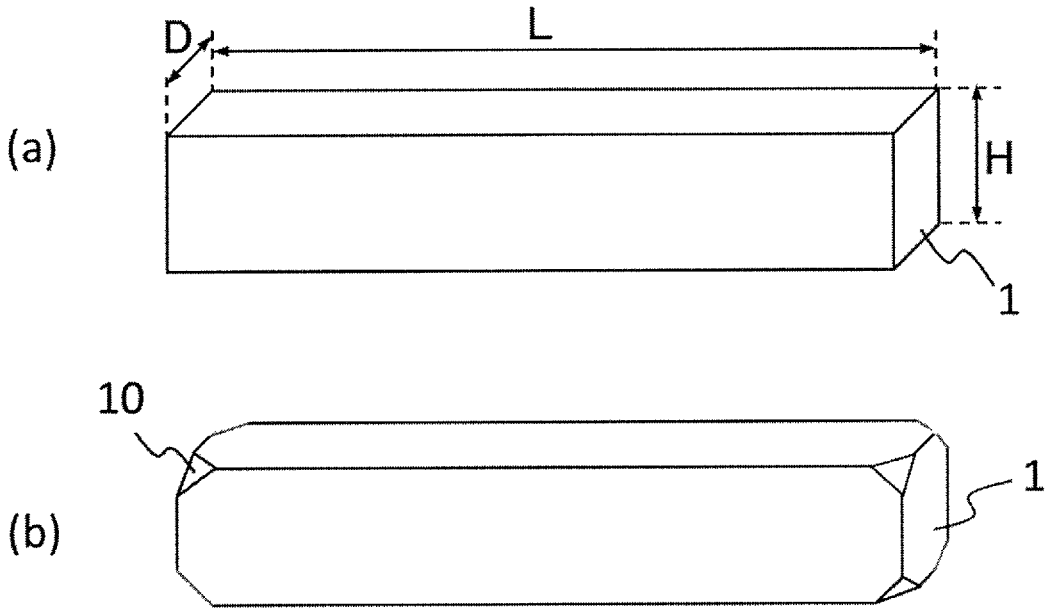
FIG. 1(*a*) and FIG. 1(*b*) are each an isometric view showing an example of shape of a sintered magnet body.

In a non-limiting illustrative embodiment of this disclosure, a plurality of sintered R-T-B based magnet bodies and a plurality of alloy powder particles, as RH diffusion sources, adjusted to have a size of 90 μm or less (preferably 38 μm or greater and 75 μm or less) are prepared. The plurality of sintered R-T-B based magnet bodies, and the plurality of alloy powder particles of a ratio of 2% by weight or greater and 15% by weight or less (preferably 3% by weight or greater and 7% by weight or less) with respect to the plurality of sintered R-T-B based magnet bodies, are loaded into a process chamber and subjected to an RH supply and diffusion process. The RH supply and diffusion process is performed as disclosed in Patent Document No. 3, as follows. The process chamber is heated and also rotated and/or swung, so that the sintered R-T-B based magnet bodies and the alloy powder particles are moved continuously or intermittently.

With the method described in Patent Document No. 3, there is no specific limitation on the size of the RH diffusion sources. Patent Document No. 3 does not describe, either, how much amount of RH diffusion sources of a specific size are to be loaded with respect to the sintered R-T-B based magnet bodies. The present inventors, as a result of thorough studies on the method described in Patent Document No. 3, have found that a high value of $H_{cJ}$ is obtained stably by preparing alloy powder particles of a specific size as the RH diffusion sources and loading the alloy powder particles of the specific size at a specific weight ratio with respect to the sintered R-T-B based magnet bodies.

In this disclosure, the phrase "RH supply and diffusion process" refers to supplying a heavy rare earth element RH to a sintered R-T-B based magnet body while diffusing the heavy rare earth element RH to the inside of the magnet. The phrase "RH diffusion process" refers to, after the RH supply and diffusion process, diffusing the heavy rare earth element RH to the inside of the sintered R-T-B based magnet without supplying the heavy rare earth element RH. Heat treatment performed for the purpose of improving the magnet characteristics of the sintered R-T-B based magnet after the RH supply and diffusion process or after the RH diffusion process is referred to simply as "heat treatment".

[Step of Preparing a Plurality of Sintered R-T-B Based Magnet Bodies]

In an embodiment according to the present invention, a sintered R-T-B based magnet body (R is at least one of rare earth elements and necessary contains Nd and/or Pt; and T is at least one of transition metals and necessarily contains Fe) may be any sintered R-T-B based magnet body produced by a known method with a known composition. Preferably, the sintered R-T-B based magnet body necessarily contains Rd.

In this disclosure, a sintered R-T-B based magnet before the RH supply and diffusion process or during the RH supply and diffusion process is referred to as an "sintered R-T-B based magnet body", and a sintered R-T-B based magnet after the RH supply and diffusion process is referred to as a "sintered R-T-B based magnet".

In an embodiment of this disclosure, the sintered R-T-B based magnet body has, for example, the following composition.

Rare earth elements: 12 to 17% by atom

Boron (may partially be replaced with Carbon): 5 to 8% by atom

Additive element M (at least one selected from the group consisting of Al, Ti, V, Cr, Mn, Ni, Cu, Zn, Ga, Zr, Nb, Mo, Ag, In, Sn, Hf, Ta, W, Pb and Bi): 0 to 2% by atom T (transition metal mainly containing Fe; may contain Co) and unavoidable impurities: the remaining part The sintered R-T-B based magnet body having the above-described composition is produced by a known production method.

FIG. 1 provides isometric views each showing an example of shape of a sintered magnet body 1. FIG. 1(*a*) shows the size of the sintered magnet body 1, namely, length L, depth D, and height H. FIG. 1(*b*) shows the sintered magnet body shown in FIG. 1(*a*) after eight apexes thereof are chamfered.

In an embodiment, the plurality of sintered magnet bodies each have a rectangular shape having a length (L) of one side of 40 mm or greater and a length (D, H) of each of the other two sides of 20 mm or less. In another embodiment, the plurality of sintered magnet bodies may each have a generally rectangular shape having a length of one side of 50 mm or greater and a length of each of the other two sides of 10 mm or less. The apexes of each of the sintered magnet bodies may be chamfered as shown in FIG. 1(*b*). The chamfering may contribute suppression of cracks or breakages.

The shape or the size of the sintered magnet bodies to which the production method of this disclosure is applicable are not limited to the above-described examples.

[Step of Preparing a Plurality of Alloy Powder Particles]

In an embodiment according to the present invention, a plurality of alloy powder particles having a size of 90 μm or less and containing a heavy rare earth element RH at a content of 20 mass % of greater and 80 mass % or less are prepared as the RH diffusion sources. According to the present invention, the heavy rare earth element RH is Tb and/or Dy. For example, a TbFe alloy, a DyFe alloy or the like containing Tb and/or Dy at a content of 20 mass % of greater and 80 mass % or less is usable. A higher value of $H_{cJ}$ is obtained with Tb than with Dy. When the content of the heavy rare earth element RH is less than 20 mass %, the supply amount of the rare earth element RH is too small, and a high value of $H_{cJ}$ may not obtained. When the content of the heavy rare earth element RH exceeds 80 mass %, the RH diffusion sources may undesirably catch fire when being loaded into the process chamber. The content of the RH heavy rare earth element RH in the RH diffusion sources is preferably 35 mass % or greater and 65 mass % or less, and is more preferably 40 mass % or greater and 60 mass % or less.

In an embodiment according to the present invention, there is no specific limitation on the method of preparing the plurality of alloy powder particles having a size of 90 μm or less. For example, classification by use of a sieve having openings of 90 μm (standard sieve of JIS Z 8801-2000) may be performed. Without the alloy powder particles having a size of 90 μm or less, a high value of $H_{cJ}$ is not obtained stably. In order to obtain the alloy powder particles having a size of 90 μm or less, an alloy containing a heavy rare earth element RH at a content of 20 mass % of greater and 80 mass % or less may be pulverized by a known method such as, for example, use of a pin mill pulverizer, and classified by use of a sieve having openings of 90 μm.

The use of the known method, for example, the use of a pin mill pulverizer as described above for producing a plurality of alloy powder particles having a size of 90 μm or less may be low in mass productivity because it is time-consuming to pulverize the alloy to the size of 90 μm or less and the pulverization by use of a pin mill needs to be performed a plurality of times. Instead of such a method, hydrogen pulverization may be used. The hydrogen pulverization is performed as follows. Hydrogen is caused to be occluded in an alloy containing a heavy rare earth element RH at a content of 35 mass % or greater and 50 mass % or less, and then dehydrogenation is performed, more specifically, the resulting substance is heated to a temperature of 400° C. or higher and 550° C. or lower. With the hydrogen pulverization, the plurality of alloy powder particles are mostly (90% by weight or greater) pulverized to a size of 90 μm or less. Therefore, a large amount of alloy powder particles having a size of 90 μm or less are obtained relatively simply and in one step. This allows the plurality of alloy powder particles to be loaded into the process chamber for the RH supply and diffusion process without being classified by use of a sieve having openings of 90 μm. In this case, if the plurality of alloy powder particles are loaded at a ratio of 2% by weight, which is the lower limit of the weight ratio, with respect to the plurality of sintered R-T-B based magnet bodies for the RH supply and diffusion process, the weight ratio of the plurality of alloy powder particles having a size of 90 μm or less may be less than 2%. Therefore, it is preferable to load the plurality of alloy powder particles at a ratio of 2.2% by weight or greater.

For the hydrogen pulverization, an alloy containing a heavy rare earth element RH at a content of 35 mass % or greater and 50 mass % or less is prepared. When the content of the heavy rare earth element RH is less than 35 mass %, the alloy may not be pulverized to a size of 90 μm or less. By contrast, when the content of the heavy rare earth element RH exceeds 50 mass %, a large amount of hydrogen may remain. Therefore, the content of the heavy rare earth element RH is preferably 35 mass % or greater and 50 mass % or less. The hydrogen pulverization is performed on such an alloy. For the hydrogen pulverization, hydrogen is once caused to be occluded in the alloy and then is released. Thus, the hydrogen pulverization includes a hydrogen occlusion step and a dehydrogenation step. In the hydrogen pulverization according to the present invention, the hydrogen occlusion step may be performed by a known method. For example, the alloy is loaded into a hydrogen furnace, and then hydrogen is started to be supplied to the hydrogen furnace at room temperature. The hydrogen occlusion step is performed, more specifically, the absolute pressure of hydrogen is kept at about 0.3 MPa, for 90 minutes. In this step, as the hydrogen occlusion reaction of the alloy powder advances, hydrogen in the furnace is consumed and the pressure of hydrogen is decreased. Therefore, hydrogen is additionally supplied in order to compensate for the decrease so that the pressure is controlled to be about 0.3 MPa. In the dehydrogenation step, the post-hydrogen occlusion step alloy is heated to a temperature of 400° C. or higher and 550° C. or lower in vacuum. This step allows the alloy to be pulverized to a size of 90 μm without hydrogen remaining almost at all. When the heating temperature is lower than 400° C. or higher than 550° C., hydrogen (about several hundred ppm) remains in the plurality of alloy powder particles. If remaining, the hydrogen is supplied from the plurality of alloy powder particles to the sintered R-T-B based magnet bodies during the RH supply and diffusion process performed later. As a result, hydrogen embrittlement occurs to the sintered R-T-B based magnets obtained as final products. If this occurs, the sintered R-T-B based magnets are not usable as products. Therefore, the heating temperature in the dehydrogenation step is preferably 400° C. or higher and 550° C. or lower.

The size of each of the alloy powder particles is preferably 38 μm or greater and 75 μm or less, and is more preferably 38 μm or greater and 63 μm or less. With such a size, a high value of $H_{cJ}$ is obtained more stably. When many alloy powder particles having a size of less than 38 μm are contained, the alloy powder particles are too small and the RH diffusion sources may catch fire. The alloy powder particles may contain at least one of Nd, Pr, La, Ce, Zn, Zr, Sm and Co in addition to Tb, Dy and Fe as long as the effect of the present invention is not spoiled. The alloy powder particles may contain Al, Ti, V, Cr, Mn, Ni, Cu, Ga, Nb, Mo, Ag, In, Hf, Ta, W, Pb, Si, Bi and the like as unavoidable impurities.

Preferably, the plurality of alloy powder particles at least partially contain alloy powder particles having an exposed new surface. In an embodiment according to the present invention, the expression that a "new surface is exposed" indicates that foreign substances other than the RH diffusion sources, for example, R oxides or R-T-B compounds (compounds having a composition close to that of the main phase) or the like are not present on the surface of the alloy powder particles. As described above, the plurality of alloy powder particles are prepared by pulverizing an alloy containing a heavy rare earth element at a content of 20 mass % or greater and 80 mass % or less. Therefore, the plurality of alloy powder particles obtained in this manner at least contain alloy powder particles having an exposed new surface. However, the RH supply and diffusion process may be repeated, namely, a plurality of new sintered R-T-B based magnet bodies may be prepared in place of the post-RH supply and diffusion process sintered R-T-B based magnets, and the plurality of new sintered R-T-B based magnet bodies and the plurality of post-RH supply and diffusion process alloy powder particles (used alloy powder particles) may be used to perform the RH supply and diffusion process again. In this case, even if a plurality of alloy powder particles having a size of 90 μm or less are present after the RH supply and diffusion process, the surface of the post-RH supply and diffusion process alloy powder particles may be entirely covered with foreign substances, R oxides or the like and the new surface may not be exposed. For this reason, in the case where the RH supply and diffusion process is repeated by use of the post-process alloy powder particles, the amount of the heavy rare earth element RH supplied to the sintered R-T-B based magnet bodies may be decreased by the foreign substances, R-oxides or the like. Therefore, it is preferable that the plurality of post-process alloy powder particles are pulverized by a known pulverizer or the like, so that the alloy powder particles are kept in a state of having a ruptured surface exposed, namely, having a new surface exposed.

[Step of Loading the Sintered R-T-B Based Magnet Bodies and the Alloy Powder Particles]

The plurality of sintered R-T-B based magnet bodies, and a plurality of alloy powder particles of a ratio of 2% by weight or greater and 15% by weight or less with respect to the plurality of sintered R-T-B based magnet bodies, are loaded into a process chamber. This allows a high value of $H_{cJ}$ to be obtained stably as a result of the RH supply and diffusion process performed later. When the weight ratio of the plurality of alloy powder particles having a size of 90 μm or less with respect to the sintered R-T-B based magnet bodies is less than 2%, the number of the alloy powder particles having a size of 90 μm or less is too small. Therefore, a high value of $H_{cJ}$ is not obtained stably. When the weight ratio exceeds 15%, the alloy powder particles excessively react with a liquid phase exuding out from the sintered R-T-B based magnet bodies and are abnormally attached to the surface of the sintered R-T-B based magnet bodies. Such a phenomenon generates a state where it is difficult for the heavy rare earth element RH to be newly supplied to the sintered R-T-B based magnet bodies. Therefore, a high value of $H_{cJ}$ is not obtained stably. For this reason, the alloy powder particles having a size of 90 μm or less, which are necessary to obtain a high value of $H_{cJ}$ stably, needs to be provided in an amount of a specific range (2% or greater and 15% or less). Preferably, the weight ratio of the amount of the plurality of alloy powder particles with respect to the plurality of sintered R-T-B based magnet bodies is 3% or greater and 7% or less. With such a range, a high value of $H_{cJ}$ is obtained more stably.

As long as the plurality of alloy powder particles having a size of 90 μm or less are loaded at a ratio of 2% or greater and 15% or less with respect to the plurality of sintered R-T-B based magnet bodies, namely, as long as the condition according to the present invention is fulfilled, a plurality of alloy powder particles having a size, for example, exceeding 90 μm may be additionally loaded into the process chamber. It should be noted that it is preferable that the plurality of alloy powder particles having a size exceeding 90 μm are not used because the heavy rare earth element RH is a rare metal and the amount of use thereof is demanded to be decreased. Therefore, it is preferable that, for example, only a plurality of sintered R-T-B based magnet bodies, the plurality of alloy powder particles having a size of 90 μm or less, and a plurality of stirring aid members are accommodated in the process chamber as solids during the RH supply and diffusion process. When there are too many alloy powder particles having a size exceeding 90 μm, the amount of the sintered R-T-B based magnet bodies that can be processed in one cycle is decreased. Therefore, it is preferable that the weight ratio of the sintered R-T-B based magnet bodies and the alloy powder particles (total of the alloy powder particles having a size of 90 μm or less and the alloy powder particles having a size exceeding 90 μm) to be loaded into the process chamber is 1:0.02 to 2.

In an embodiment according to the present invention, the plurality of stirring aid members are further loaded into the process chamber. The stirring aid members promote contact of the alloy powder particles and the sintered R-T-B based magnet bodies, and indirectly supply the heavy rare earth element RH, once attached to the stirring aid members, to the sintered R-T-B based magnet bodies. The stirring aid members also have a role of preventing the sintered R-T-B based magnet bodies from being broken as a result of contacting each other in the process chamber. The amount of the stirring aid members to be loaded into the process chamber is preferably in the range of about 100% by weight to about 300% by weight with respect to the sintered R-T-B based magnet bodies.

It is effective that the stirring aid members have a shape easy to move in the process chamber and are mixed with the sintered R-T-B based magnet bodies and the alloy powder particles while the process chamber is rotated and/or swung. Examples of the shape easy to move include a spherical shape, a cylindrical shape and the like having a diameter of several hundred micrometers to several ten millimeters. It is preferable that the stirring aid members are formed of a material that is not easily reacted with the sintered R-T-B based magnet bodies or the alloy powder particles during the RH supply and diffusion process. Preferable examples of the material of the stirring aid members include zirconia, silicon nitride, silicon carbide, boron nitride, ceramics as mixtures thereof, and the like. The stirring aid members may be formed of an element of a group containing Mo, W, Nb, Ta, Hf or Zr, a mixture thereof, or the like.

[Step of Performing the RH Supply and Diffusion Process]

Figure 2:
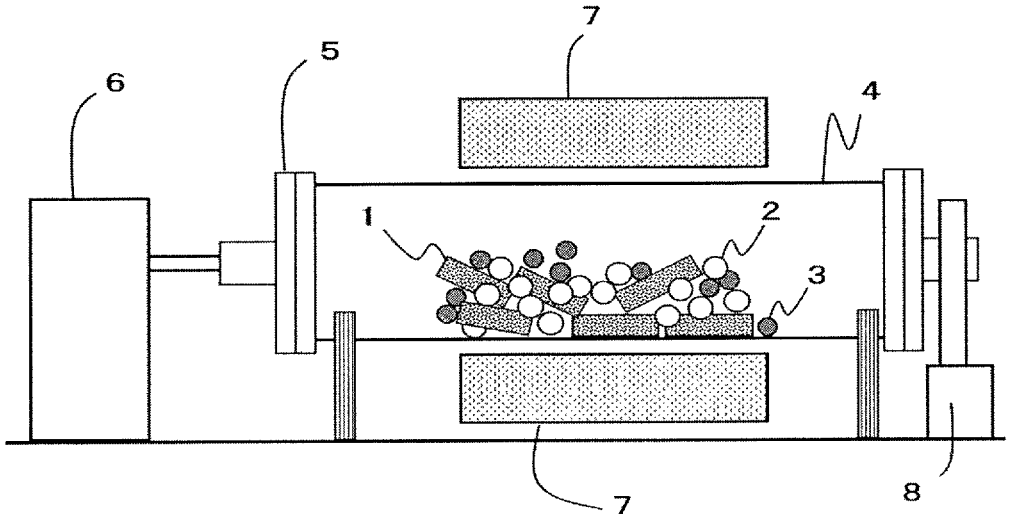
FIG. 2 is a cross-sectional view schematically showing an example of device usable for an RH supply and diffusion process according to the present invention.

In the above-described step, the process chamber accommodating the plurality of sintered R-T-B based magnet bodies and the plurality of alloy powder particles is heated while being rotated and/or swung. Thus, the sintered R-T-B based magnet bodies and the alloy powder particles are moved continuously or intermittently, so that the RH supply and diffusion process is performed. In the RH supply and diffusion process, the heavy rare earth element RH is supplied from the alloy powder particles to the surface of the sintered R-T-B based magnet bodies while being diffused to the inside of the sintered R-T-B based magnet bodies. As a result, a high value of $H_{cJ}$ is obtained stably while the decrease in $B_r$ is suppressed. The RH supply and diffusion process in an embodiment according to the present invention may be performed by a known method described in Patent Document No. 3 FIG. 2 is a cross-sectional view schematically showing an example of equipment usable for the RH supply and diffusion process in an embodiment according to the present invention. A method for using the equipment will be described with reference to FIG. 2. First, referring to FIG. 2, a cap 5 is removed from a process chamber 4, and a plurality of sintered R-T-B based magnet bodies 1, a plurality of alloy powder particles 2 and a plurality of stirring aid members 3 are loaded into the process chamber 4. The cap 5 is attached to the process chamber 4. The amount ratio of the sintered R-T-B based magnet bodies 1, the alloy powder particles 2 and stirring aid members 3 is set to be in the above-described predetermined range.

Next, the inside of the process chamber 4 is vacuum-evacuated by an exhaust system 6 to decrease the inner pressure thereof (after the decrease of the pressure, Ar gas or the like may be introduced). The process chamber 4 is heated by a heater 7 while being rotated by a motor 8. The rotation of the process chamber 4 stirs the sintered R-T-B based magnet bodies 1, the alloy powder particles 2 and the stirring aid members 3 uniformly as shown in the figure, so that the RH supply and diffusion process is performed smoothly.

The process chamber 4 shown in FIG. 2 is formed of stainless steel. The process chamber 4 is not limited to being formed of stainless steel, and may be formed of any material that is resistant against a temperature of 1000° C. or higher and is not easily reacted with the sintered R-T-B based magnet bodies 1, the alloy powder particles 2 or the stirring aid members 3. For example, an alloy containing at least one of N, Mo and W, an Fe—Cr—Al-based alloy, an Fe—Cr—Co-based alloy or the like is usable. The process chamber 4 includes the cap 5 that is openable/closable or detachable. The process chamber 4 may have a protrusion provided on an inner wall thereof so as to move the sintered R-T-B based magnet bodies 1, the alloy powder particles 2 and the stirring aid members 3 efficiently. The process chamber 4 may be elliptical or polygonal instead of being circular. The process chamber 4 may be coupled with the exhaust system 6, and the inner pressure of the process chamber 4 is decreased or increased by the exhaust system 6. The process chamber 4 is connected with a gas supply device (not shown), so that inert gas or the like is introduced from the gas supply device into the process chamber.

The process chamber 4 is heated by the heater 7 located at an outer periphery thereof. A typical example of the heater 7 is a resistance heater generating heat by an electric current. The heating of the process chamber 4 also heats the sintered R-T-B based magnet bodies 1, the alloy powder particles 2 and the stirring aid members 3 loaded therein. The process chamber 4 is rotatably supported and is rotatable by the motor 8 even while being heated by the heater 7. The rotational speed of the process chamber 4, which is represented by the surface velocity at the inner wall of the process chamber 4, is preferably set to be 0.01 m or greater per second. The surface velocity is preferably set to be 0.5 m or greater per second so as to prevent the sintered R-T-B based magnet bodies in the process chamber from colliding against each other violently.

In this embodiment, the sintered R-T-B based magnet bodies 1, the alloy powder particles 2 and the stirring aid members 3 in the process chamber 4 reach substantially the same temperature. In an embodiment of this disclosure, Dy and Tb, which are relatively difficult to be vaporized, do not need to be heated to a temperature of, for example, 1000° C. or higher. Therefore, the RH supply and diffusion process may be performed at a temperature suitable to diffuse Dy and/or Tb to the inside of the sintered R-T-B based magnet bodies 1 via the grain boundary phase of the sintered R-T-B based magnet bodies 1 (800° C. or higher and 1000° C. or lower).

When the sintered R-T-B based magnet bodies 1 and the alloy powder particles 2 contact each other, the heavy rare earth element RH is supplied from the alloy powder particles 2 to the surface of the sintered R-T-B based magnet bodies 1. The heavy rare earth element RH is diffused to the inside of the sintered R-T-B based magnet bodies 1 via the grain boundary phase of the sintered R-T-B based magnet bodies 1 during the RH supply and diffusion process. Such a method does not require a thick film of the heavy rare earth element RH to be formed on the surface of the sintered R-T-B based magnet bodies 1. Therefore, even if the temperature of the alloy powder particles 2 is almost equal to the temperature of the sintered R-T-B based magnet bodies 1 (800° C. or higher and 1000° C. or lower) (namely, even if the temperature difference is, for example, 50° C. or less), the supply and the diffusion of the heavy rare earth element RH are realized at the same time.

The alloy powder particles 2 must be heated to a high temperature to vaporize Dy or Tb actively from the alloy powder particles 2, so that a thick film of the heavy rare earth element RH is formed on the surface of the sintered R-T-B based magnet bodies 1. In order to realize this, the alloy powder particles 2 need to be selectively heated during the RH supply and diffusion process to a temperature much higher than the temperature of the sintered R-T-B based magnet bodies 1. Such heating cannot be performed by the heater 7 located outer to the process chamber 7, and needs to be performed by, for example, induction heating of directing microwaves only to the alloy powder particles 2. In this case, the alloy powder particles 2 need to be located away from the sintered R-T-B based magnet bodies 1 and the stirring aid members 3. Therefore, the sintered R-T-B based magnet bodies 1, the alloy powder particles 2 and the stirring aid members 3, which are stirred in the process chamber 4 in an embodiment of this disclosure, cannot be stirred in the process chamber 4.

During the heating, the process chamber 4 preferably has an inert atmosphere therein. In this disclosure, the term "inert atmosphere" encompasses vacuum and inert gas atmosphere. The term "inert gas" is noble gas such as, for example, argon (Ar) gas or the like. In this disclosure, the "inert gas" encompasses any type of gas that is not chemically reacted with the sintered R-T-B based magnet bodies 1, the alloy powder particles 2 or the stirring aid members 3. The inner pressure of the process chamber 4 is preferably 1 kPa or less.

In the RH supply and diffusion process in an embodiment according to the present invention, at least the sintered R-T-B based magnet bodies 1 and the alloy powder particles 2 are held at a temperature in the range of, preferably, 500° C. or higher and 850° C. or lower, more preferably, 700° C. or higher and 850° C. or lower. In such a preferable temperature range, while the sintered R-T-B based magnet bodies 1 and the alloy powder particles 2 move with respect to each other to be closer to, or contact, each other in the process chamber, the heavy rare earth element RH is diffused to the inside of the sintered R-T-B based magnet bodies via the grain boundary phase thereof. In such a temperature range, the diffusion of the heavy rare earth element RH to the inside of the sintered R-T-B based magnet bodies is performed efficiently. The time period in which the sintered R-T-B based magnet bodies 1, the alloy powder particles 2 and the stirring aid members 3 are kept at a temperature in such a range may be determined in consideration of the amount, the shape or the like of each of the sintered R-T-B based magnet bodies 1, the alloy powder particles 2 and the stirring aid members 3. The time period is, for example, 10 minutes to 72 hours, and is preferably 1 hour to 4 hours. In FIG. 2, the process chamber 4 is rotatable. The process chamber 4 may be swingable, or rotatable and also swingable.

[Example of Heat Pattern]

Figure 3:
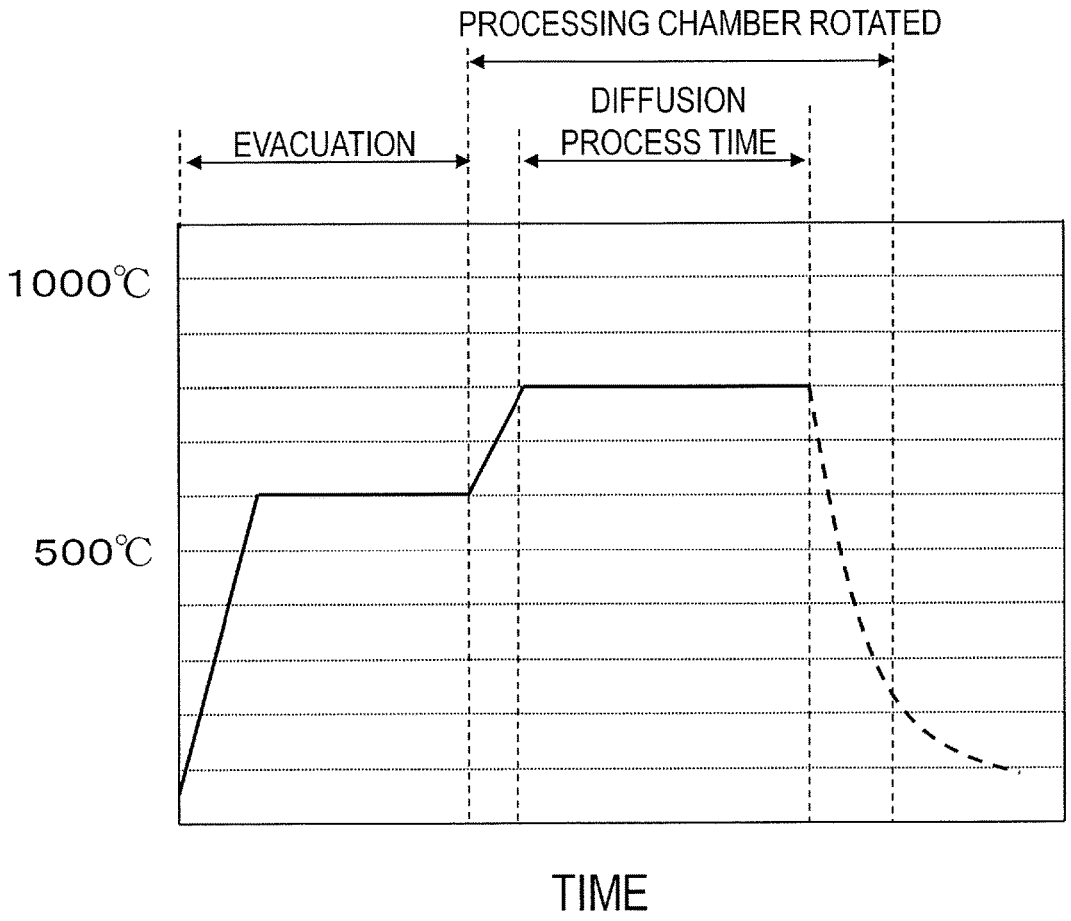
FIG. 3 is a graph showing an example of heat pattern in a diffusion process step.

The temperature of the process chamber 4 changes during the RH supply and diffusion process as shown in, for example, FIG. 3. FIG. 3 is a graph showing an example of change of the temperature in the process chamber (heat pattern) after the heating is started. In the example shown in FIG. 3, vacuum evaluation was performed while the temperature was increased by a heater. The temperature increasing rate was about 5° C./min. The temperature was kept at, for example, about 600° C. until the pressure in the process chamber reached a desired level. Then, the process chamber was started to be rotated. The temperature was increased until reaching a diffusion process temperature. The temperature increasing rate was about 5° C./min. When the diffusion process temperature was reached, the temperature was kept at the diffusion process temperature for a predetermined time period. Then, the heating by the heater was stopped, and the temperature was decreased to about room temperature. Then, the sintered R-T-B based magnet bodies removed from the device shown in FIG. 2 were loaded into a heat treatment furnace. A first heat treatment was performed (800° C. to 950° C.×4 hours to 10 hours) at the same atmospheric pressure as that during the diffusion process, and then a second heat treatment was performed (450° C. to 550° C.×3 hours to 5 hours). The temperature and the time period for the first heat treatment and the second heat treatment are set in consideration of the amount of each of the sintered R-T-B based magnet bodies 1, the alloy powder particles 2 and the stirring aid members 3, the composition of the alloy powder particles 2, the temperature of RH supply and diffusion process, or the like.

The heat pattern that can be realized by the diffusion process in this disclosure is not limited to the pattern shown in FIG. 3, and may be any of various patterns. The vacuum evacuation may be performed until the sintered magnet bodies are fully cooled after the finish of the diffusion process.

After the RH supply and diffusion process, the sintered R-T-B based magnets, the alloy powder particles and the stirring aid members may be separated from each other by a known method. There is no specific limitation on the method. For example, vibration of a punching metal may be used for the separation.

After the RH supply and diffusion process, an RH diffusion process of diffusing the heavy rare earth element RH to the inside of the sintered R-T-B based magnets may be performed with no supply of the heavy rare earth element RH. This diffuses the heavy rare earth element RH inside the sintered R-T-B based magnets. The heavy rare earth element RH is diffused deep into the sintered R-T-B based magnets from the surface thereof. As a result, the value of $H_{cJ}$ of the entirety of the magnets is improved. The RH diffusion process is a process of heating the sintered R-T-B based magnets to a temperature in the range of 700° C. or higher and 1000° C. or lower in a state where the heavy rare earth element RH is not supplied from the alloy powder particles to the sintered R-T-B based magnets. The time period of the RH diffusion process is, for example, 10 minutes to 72 hours, and is preferably 1 hour to 12 hours.

After the RH supply and diffusion process, or after the RH diffusion process, a heat treatment may be performed for the purpose of improving the magnetic characteristics of the sintered R-T-B based magnets. This heat treatment is substantially the same as that performed after the sintering in a known method for producing a sintered R-T-B based magnet. The heat treatment atmosphere, the heat treatment temperature or the like may be selected from known conditions.

EXAMPLES

An embodiment according to the present invention will be described in more detail by way of examples. The present invention is not limited to any of the following examples.

Example 1

Nd metal, Pr metal, Dy metal, ferroboron alloy, electrolytic Co, Al metal, Cu metal, Ga metal and electrolytic iron (all the metals had a purity of 99% or greater) were combined to form the compositions of material No. A and material No. B in Table 1. Each of the materials was melted and cast by a strip-cast method to obtain a material alloy flake having a thickness of 0.2 to 0.4 mm. The obtained material alloy flake was subjected to hydrogen embrittlement in a hydrogen-pressure atmosphere, and then was dehydrogenated, more specifically, was heated to 550° C. in vacuum and cooled. As a result, coarsely pulverized powder was obtained. Next, the obtained coarsely pulverized powder was mixed with zinc stearate as a lubricant at a content of 0.04 parts by mass with respect to 100 parts by mass of the coarsely pulverized powder, and the resultant mixture was dry-pulverized in a nitrogen flow by use of a jet mill device. As a result, finely pulverized powder having diameter D50 of 4 μm was obtained. Diameter D50 is a volume-based median diameter obtained by gas flow diffusion-type laser diffraction.

The finely pulverized powder was mixed with zinc stearate as a lubricant at a content of 0.05 parts by mass with respect to 100 parts by mass of the finely pulverized powder, and then the resultant mixture was compacted in a magnetic field. As a result, a powder compact body was obtained. A so-called perpendicular magnetic field compacting device (transverse magnetic field compacting device) was used as a compacting device. In the transverse magnetic field compacting device, the magnetic field application direction and the pressurization direction are perpendicular to each other. The obtained powder compact was sintered at 1070° C. to 1090° C. for 4 hours in vacuum in accordance with the composition. As a result, sintered R-T-B based magnet bodies of material No. A and material No. B were obtained. The sintered R-T-B based magnet bodies had a density of 7.5 $Mg/m^3$ or greater. Table 1 shows the analysis results of the components of the obtained sintered R-T-B based magnet bodies of material No. A and material No. B. The mass ratio (%) of each of the components in Table 1 was measured by radio frequency inductively coupled plasma optical emission spectroscopy (ICP-OES). The mass ratio of 0 (amount of oxygen) was measured by a gas fusion-infrared absorption method. The mass ratio of N (amount of nitrogen) was measured by a gas fusion-heat transfer method. The mass ratio of C (amount of carbon) was performed by a combustion-infrared absorption method. These measurements were performed by a gas analyzer.

TABLE 1

| Material | Analysis results of the sintered R-T-B based magnets (mass %) | | | | | | | | | | | |
|---|---|---|---|---|---|---|---|---|---|---|---|---|
| No. | Nd | Pr | Dy | B | Co | Al | Cu | Ga | Fe | O | N | C |
| A | 23.0 | 7.0 | 0.0 | 1.0 | 2.0 | 0.4 | 0.1 | 0.3 | bal. | 0.07 | 0.05 | 0.09 |
| B | 22.7 | 7.0 | 0.3 | 1.0 | 2.0 | 0.1 | 0.1 | 0.3 | bal. | 0.07 | 0.05 | 0.09 |

Next, Tb metal and electrolytic iron were combined to form a material alloy of $TbFe_3$ (Tb: 48.7 mass %, Fe: 51.3 mass %). The material alloy was melted and cast by a strip-cast method to obtain a $TbFe_3$ alloy flake having a thickness of 0.2 to 0.4 mm.

The $TbFe_3$ alloy was pulverized by a pin mill and then screened with each of the sieves conformed to JIS shown in Table 2. As a result, a plurality of alloy powder particles were obtained as samples Nos. a through g. This will be described in more detail. The plurality of alloy powder particles pulverized by the pin mill were screened with a sieve having openings of 1000 μm, and the alloy powder particles that passed the sieve of 1000 μm were screened with a sieve having openings of 212 μm. Alloy powder particles sample No. a in Table 2 are the alloy powder particles that did not pass the sieve of 212 μm. Alloy powder particles samples Nos. b through f are shown in substantially the same manner. Alloy powder particles sample No. g are alloy powder particles that passed a sieve of 38 μm. As stirring aid members, a plurality of zirconia balls having a diameter of 5 mm were prepared.

TABLE 2

| Alloy powder No. | Size of openings of the sieve conformed to JIS [μm] Upper limit | Lower limit | |
|---|---|---|---|
| a | 1000 | 212 | Comparative example |
| b | 212 | 150 | Comparative example |
| c | 150 | 106 | Comparative example |
| d | 90 | 75 | Present invention |
| e | 75 | 63 | Present invention |
| f | 63 | 38 | Present invention |
| g | 38 | — | Present invention |

The sintered R-T-B based magnet bodies, the plurality of alloy powder particles of a ratio of 3% by weight with respect to the sintered R-T-B based magnet bodies, and the stirring aid members of 100% by weight with respect to the sintered R-T-B based magnet bodies were loaded into the process chamber shown in FIG. 2. The inside of the process chamber was vacuum-evacuated, and then Ar gas was introduced. The inside of the process chamber was heated while the process chamber was rotated to perform the RH supply and diffusion process. The process chamber was rotated at a surface velocity of 0.03 m per second, and the temperature in the process chamber was increased to 930° C. and kept at 930° C. for 6 hours. The post-RH supply and diffusion process sintered R-T-B based magnets were loaded into a heat treatment furnace, and was heat-treated. More specifically, the heat treatment furnace was heated to 500° C. and kept at 500° C. for 2 hours. Material No. A and material No. B of the sintered R-T-B based magnet bodies in Table 1 were obtained as a result of being processed separately (RH supply and diffusion process and heat treatment).

Table 3 shows the measurement results of the magnetic characteristics of the obtained sintered R-T-B based magnets. In Table 3, the values of $B_r$ and $H_{cJ}$ were each obtained as follows. The post-heat treatment sintered R-T-B based magnets were mechanically processed, more specifically, were shaved at all the surfaces by 0.1 mm to obtain samples each having a size of 7 mm×7 mm×7 mm. The values of $B_r$ and $H_{cJ}$ were measured by a BH tracer. In Table 3, sample No. 1 was obtained as a result of the RH supply and diffusion process performed using alloy powder sample No. a and sintered R-T-B based magnet bodies of material No. A. Samples Nos. 2 through 14 are shown in substantially the same manner.

TABLE 3

| Sample No. | Alloy powder No. | Size of openings of the sieve conformed to JIS [μm] Upper limit | Lower limit | Material No. | Br [T] | HcJ [kA/m] | |
|---|---|---|---|---|---|---|---|
| 1 | a | 1000 | 212 | A | 1.40 | 1393 | Comparative example |
| 2 | b | 212 | 150 | A | 1.40 | 1410 | Comparative example |
| 3 | c | 150 | 106 | A | 1.40 | 1647 | Comparative example |
| 4 | d | 90 | 75 | A | 1.40 | 1820 | Present invention |
| 5 | e | 75 | 63 | A | 1.40 | 1897 | Present invention |
| 6 | f | 63 | 38 | A | 1.40 | 1914 | Present invention |
| 7 | g | 38 | — | A | 1.40 | 1892 | Present invention |
| 8 | a | 1000 | 212 | B | 1.40 | 1381 | Comparative example |
| 9 | b | 212 | 150 | B | 1.40 | 1398 | Comparative example |
| 10 | c | 150 | 106 | B | 1.40 | 1635 | Comparative example |
| 11 | d | 90 | 75 | B | 1.40 | 1808 | Present invention |
| 12 | e | 75 | 63 | B | 1.40 | 1885 | Present invention |
| 13 | f | 63 | 38 | B | 1.40 | 1902 | Present invention |
| 14 | g | 38 | — | B | 1.40 | 1880 | Present invention |

In an embodiment according to the present invention, the alloy powder particles having a size of 90 μm or less were loaded into the process chamber at a ratio of 3% by weight with respect to the sintered R-T-B based magnet bodies, and the process chamber was rotated while being heated to perform the RH supply and diffusion process. As a result, the sintered R-T-B based magnets (samples Nos. 4 through 7 and 11 through 14) were obtained. As shown in Table 3, these samples have a higher value of $H_{cJ}$ than sintered R-T-B based magnets in comparative examples (samples Nos. 1 through 3 and 8 through 10), in which alloy powder particles having a size exceeding 90 μm were used. With the alloy powder particles having a size exceeding 90 μm, the value of $H_{cJ}$ changes significantly (for example, with the same material, for example, material No. A, the value of $H_{cJ}$ changes in the range of 1393 kA/m to 1647 kA/m as with samples Nos. 1 through 3). With the alloy powder particles having a size in the range of the present invention, a high value of $H_{cJ}$ is obtained stably (for example, with the same material, for example, material No. A, the value of $H_{cJ}$ merely changes in the range of 1820 kA/m to 1914 kA/m as with samples Nos. 4 through 7). As shown in Table 3, with the alloy powder particles having a size in the range of 38 μm or greater and 75 μm or less (samples Nos. 5, 6, 12 and 13 in the embodiment according to the present invention), a high value of $H_{cJ}$ is obtained more stably. With the alloy powder particles having a size in the range of 38 μm or greater and 63 μm or less (samples Nos. 6 and 13 according to the present invention), a higher value of $H_{cJ}$ is obtained.

Example 2

Nd metal, Pr metal, ferroboron alloy, electrolytic Co, Al metal, Cu metal, Ga metal and electrolytic iron (all the metals had a purity of 99% or greater) were combined to form the composition of material No. A in Table 1. Sintered R-T-B based magnet bodies were obtained by the same method as in example 1. The components and the gas analysis results of the obtained sintered R-T-B based magnet bodies were equivalent to those of material No. A in example 1.

Next, a $TbFe_3$ alloy was prepared by substantially the same method as in example 1, pulverized by a pin mill and screened with a sieve having openings of 63 μm (conformed to JIS). As a result, a plurality of alloy powder particles having a size of 63 μm or less were obtained. As stirring aid members, a plurality of zirconia balls having a diameter of 5 mm were prepared.

The alloy powder particles, the sintered R-T-B based magnet bodies, and the stirring aid members were loaded into the process chamber shown in FIG. 2. Table 4 shows the weight ratios of the alloy powder particles with respect to the sintered R-T-B based magnet bodies. In Table 4, for example, sample No. 21 indicates that the alloy powder particles were loaded at a ratio of 1% by weight with respect to the sintered R-T-B based magnet bodies. The same is applicable to samples Nos. 22 through 32. The RH supply and diffusion process was performed by the same method as in example 1 except that the alloy powder particles were loaded into the process chamber at the mass ratios shown in Table 4. The heat treatment was performed by the same method as in example 1.

Table 4 shows the measurement results of the magnetic characteristics of the obtained sintered R-T-B based magnets. In Table 4, the values of $B_r$ and $H_{cJ}$ were each obtained as follows. The post-heat treatment sintered R-T-B based magnets were mechanically processed, more specifically, were shaved at all the surfaces by 0.1 mm to obtain samples each having a size of 7 mm×7 mm×7 mm. The values of $B_r$ and $H_{cJ}$ were measured by a BH tracer.

TABLE 4

| Sample No. | Weight ratio [%] | Br [T] | HcJ [kA/m] | |
|---|---|---|---|---|
| 21 | 1 | 1.40 | 1652 | Comparative example |
| 22 | 2 | 1.41 | 1812 | Present invention |
| 23 | 3 | 1.40 | 1903 | Present invention |
| 24 | 5 | 1.38 | 1903 | Present invention |
| 25 | 7 | 1.39 | 1903 | Present invention |
| 26 | 10 | 1.40 | 1825 | Present invention |
| 27 | 15 | 1.40 | 1807 | Present invention |
| 28 | 20 | 1.40 | 1789 | Comparative example |
| 29 | 25 | 1.41 | 1771 | Comparative example |
| 30 | 30 | 1.41 | 1753 | Comparative example |
| 31 | 50 | 1.41 | 1732 | Comparative example |
| 32 | 100 | 1.41 | 1714 | Comparative example |

According to the present invention, the alloy powder particles were loaded into the process chamber at a ratio of 2% by weight or greater and 15% by weight or less with respect to the sintered R-T-B based magnet bodies. As a result, the sintered R-T-B based magnets (samples Nos. 22 through 27) were obtained. As shown in Table 4, these samples have a higher value of $H_{cJ}$ than sintered R-T-B based magnets in comparative examples (samples Nos. 21 and 28 through 32), in which the weight ratios of the alloy powder particles were out of the range according to the present invention.

As shown in Table 4, with the alloy powder particles used at a ratio of 3% by weight or greater and 7% by weight or less with respect to the sintered R-T-B based magnet bodies, a higher value of $H_{cJ}$ is obtained.

Example 3

Nd metal, Pr metal, Dy metal, ferroboron alloy, electrolytic Co, Al metal, Cu metal, Ga metal and electrolytic iron (all the metals had a purity of 99% or greater) were combined to form the composition of material No. B in Table 1. A plurality of lots of sintered R-T-B based magnet bodies were prepared by the same method as in example 1. The components and the gas analysis results of the obtained sintered R-T-B based magnet bodies were equivalent to those of material No. B in example 1.

Next, Dy metal and electrolytic iron were combined to form $DyFe_2$ (Dy: 59.3 mass %, Fe: 40.7 mass %). Thus, a $DyFe_2$ alloy was prepared by the same method as in example 1. The $DyFe_2$ alloy was pulverized by a pin mill and then screened with each of the sieves conformed to JIS shown in Table 5. As a result, a plurality of alloy powder particles were obtained as samples Nos. p through v. The plurality of alloy powder particles pulverized by the pin mill were screened with a sieve having openings of 1000 μm, and the alloy powder particles that passed the sieve of 1000 μm were screened with a sieve having openings of 212 μm. Alloy powder particles sample No. p in Table 5 are the alloy powder particles that did not pass the sieve of 212 μm. Alloy powder particles samples Nos. q in Table 5 through u are shown in substantially the same manner. Alloy powder particles sample No. v are alloy powder particles that passed a sieve of 38 μm. As stirring aid members, a plurality of zirconia balls having a diameter of 5 mm were prepared.

TABLE 5

| Alloy powder No. | Size of openings of the sieve conformed to JIS [μm] Upper limit | Lower limit | |
|---|---|---|---|
| p | 1000 | 212 | Comparative example |
| q | 212 | 150 | Comparative example |
| r | 150 | 106 | Comparative example |
| s | 90 | 75 | Present invention |
| t | 75 | 63 | Present invention |
| u | 63 | 38 | Present invention |
| v | 38 | — | Present invention |

The alloy powder particles, one lot of the sintered R-T-B based magnet bodies, and the stirring aid members were loaded into the process chamber shown in FIG. 2. The RH supply and diffusion process was performed under the same conditions as those in example 1. The post-RH supply and diffusion process alloy powder particles (p through v) were observed by a field emission scanning electron microscope (FE-SEM). Foreign substances (e.g., R oxides or R-T-B compounds) other than the RH diffusion sources were present on the entirety of the surface. Separately, the post-RH supply and diffusion process alloy powder particles (p through v), another lot of the sintered R-T-B based magnet bodies, and the stirring aid members were loaded into the process chamber shown in FIG. 2. The RH supply and diffusion process was performed under the same conditions as those in example 1. The heat treatment was performed by the same method as in example 1. The size of the alloy powder (p through v) after the RH supply and diffusion process was not different almost at all from the size before the RH supply and diffusion process.

Table 6 shows the measurement results of the magnetic characteristics of the obtained sintered R-T-B based magnets. In Table 6, the values of $B_r$ and $H_{cJ}$ were each obtained as follows. The post-heat treatment sintered R-T-B based magnets were mechanically processed, more specifically, were shaved at all the surfaces by 0.1 mm to obtain samples each having a size of 7 mm×7 mm×7 mm. The values of $B_r$ and $H_{cJ}$ were measured by a BH tracer.

TABLE 6

| Sample No. | Alloy powder No. | Br [T] | HcJ [kA/m] | |
|---|---|---|---|---|
| 41 | p | 1.42 | 1268 | Comparative example |
| 42 | q | 1.42 | 1279 | Present invention |
| 43 | r | 1.42 | 1441 | Present invention |
| 44 | s | 1.42 | 1559 | Present invention |
| 45 | t | 1.41 | 1612 | Present invention |
| 46 | u | 1.41 | 1623 | Present invention |
| 47 | v | 1.41 | 1608 | Present invention |

As shown in Table 6, even in the case where the alloy powder particles used for the RH supply and diffusion process once are used again for the RH supply and diffusion process, the sintered R-T-B based magnets according to the present invention (samples Nos. 44 through 47) have a higher value of $H_{cJ}$ than sintered R-T-B based magnets in comparative examples (samples Nos. 41 through 43), in which alloy powder particles having a size exceeding 90 μm were used. With the alloy powder particles having a size exceeding 90 μm, the value of $H_{cJ}$ changes significantly (1268 kA/m to 1441 kA/m). By contrast, with the alloy powder particles having a size in the range of the present invention, a high value of $H_{cJ}$ is obtained stably (1559 kA/m to 1623 kA/m).

Example 4

The plurality of alloy powder particles p through v used in example 3 (alloy powder particles used for the RH supply and diffusion process in repetition) were pulverized by a pin mill and then screened again with each of the sieves conformed to JIS shown in Table 7. As a result, a plurality of alloy powder particles were obtained as samples Nos. q' through v'. As a result of performing pin mill pulverization on the alloy powder particles p through v, the particle size thereof is decreased. Thus, alloy powder sample No. p' (1000 μm to 212 μm) were not prepared. The alloy powder particles (q' through v') were observed by a field emission scanning electron microscope (FE-SEM). It was confirmed that there was a region in the surface in which no foreign substance (e.g., R oxides or R-T-B compounds) other than the RH diffusion sources was present (it was confirmed that a new surface was exposed). The plurality of alloy powder particles pulverized by the pin mill were screened with a sieve having openings of 212 μm, and the alloy powder particles that passed the sieve of 212 μm were screened with a sieve having openings of 150 μm. Alloy powder particles sample No. q' in Table 7 are the alloy powder particles that did not pass the sieve of 150 μm. Alloy powder particles samples Nos. r' through u' are shown in substantially the same manner. Alloy powder particles sample No. v' are alloy powder particles that passed a sieve of 38 μm. As stirring aid members, a plurality of zirconia balls having a diameter of 5 mm were prepared.

TABLE 7

| Alloy powder No. | Size of openings of the sieve conformed to JIS [μm] Upper limit | Lower limit | |
|---|---|---|---|
| q' | 212 | 150 | Comparative example |
| r' | 150 | 106 | Comparative example |
| s' | 90 | 75 | Present invention |
| t' | 75 | 63 | Present invention |
| u' | 63 | 38 | Present invention |
| v' | 38 | — | Present invention |

Next, sintered R-T-B based magnet bodies having the same composition as that of material No. B in Table 1 were prepared by the same method as in example 1. The components and the gas analysis results of the obtained sintered R-T-B based magnet bodies were equivalent to those of material No. B in example 1. The sintered R-T-B based magnet bodies, the alloy powder particles (q' through v'), and the stirring aid members were loaded into the process chamber shown in FIG. 2. The RH supply and diffusion process was performed by the same method as in example 1. The heat treatment was performed by the same method as in example 1.

Table 8 shows the measurement results of the magnetic characteristics of the obtained sintered R-T-B based magnets. In Table 8, the values of $B_r$ and $H_{cJ}$ were each obtained as follows. The post-heat treatment sintered R-T-B based magnets were mechanically processed, more specifically, were shaved at all the surfaces by 0.1 mm to obtain samples each having a size of 7 mm×7 mm×7 mm. The values of $B_r$ and $H_{cJ}$ were measured by a BH tracer.

TABLE 8

| Sample No. | Alloy powder No. | Size of openings of the sieve conformed to JIS [μm] Upper limit | Lower limit | Br [T] | HcJ [kA/m] | |
|---|---|---|---|---|---|---|
| 51 | q' | 212 | 150 | 1.42 | 1305 | Comparative example |
| 52 | r' | 150 | 106 | 1.42 | 1470 | Comparative example |
| 53 | s' | 90 | 75 | 1.42 | 1589 | Present invention |
| 54 | t' | 75 | 63 | 1.41 | 1642 | Present invention |
| 55 | u' | 63 | 38 | 1.41 | 1654 | Present invention |
| 56 | v' | 38 | — | 1.41 | 1635 | Present invention |

According to the present invention, the post-RH supply and diffusion process alloy powder particles were pulverized to expose a new surface in at least a part of the alloy powder particles (samples Nos. 53 through 56). As shown in Table 8, these samples has a higher value of $H_{cJ}$ than the sintered R-T-B based magnets in example 3 according to the present invention (samples Nos. 44 through 47), in which no new surface was exposed even in a part of the alloy powder particles.

Reference Example 1

Nd metal, Pr metal, ferroboron alloy, electrolytic Co, Al metal, Cu metal, Ga metal and electrolytic iron (all the metals had a purity of 99% or greater) were combined to form the composition of material No. A in Table 1. Sintered R-T-B based magnet bodies were obtained by the same method as in example 1. The components and the gas analysis results of the obtained sintered R-T-B based magnet bodies were equivalent to those of material No. A in example 1.

Next, a $TbFe_3$ alloy was prepared by the same method as in example 1. The $TbFe_3$ alloy was pulverized by a pin mill and then screened with a sieve having openings of 63 μm. The alloy powder particles that passed the sieve of 63 μm were screened with a sieve having openings of 38 μm. The alloy powder particles that did not pass the sieve of 38 μm were thus obtained. The alloy powder particles were prepared at a ratio of 3% by weight with respect to the sintered R-T-B based magnet bodies. The prepared alloy powder particles were mixed with alcohol at a mass ratio of 50% to prepare a mixed suspension. The mixed suspension was applied to the surface of the sintered R-T-B based magnet bodies (entire surface) and dried with warm air.

The sintered R-T-B based magnet bodies covered with $TbFe_3$ were subjected to an RH supply and diffusion process, more specifically, were heated to 930° C. in an Ar atmosphere and kept at 930° C. for 6 hours. A heat treatment was performed by the same method as in example 1.

Table 9 shows the measurement results of the magnetic characteristics of the obtained sintered R-T-B based magnets. In Table 9, the values of $B_r$ and $H_{cJ}$ were each obtained as follows. The post-heat treatment sintered R-T-B based magnets were mechanically processed, more specifically, were shaved at all the surfaces by 0.1 mm to obtain samples each having a size of 7 mm×7 mm×7 mm. The values of $B_r$ and $H_{cJ}$ were measured by a BH tracer.

TABLE 9

| Sample No. | Br [T] | HcJ [kA/m] | |
|---|---|---|---|
| 61 | 1.40 | 1754 | Comparative example |
| 6 | 1.40 | 1914 | Present invention |

In reference example 1, the RH supply and diffusion process was not performed according to the present invention, but was performed by the method described in Patent Document No. 2. In Table 9, sample No. 61 was produced by the same method with the same composition as sample No. 6 in example 1 except for the method of the RH supply and diffusion process. As shown in Table 9, the value of $H_{cJ}$ of sample No. 61 is significantly lower than that of sample No. 6. Namely, with the RH supply and diffusion process described in Patent Document No. 2, a high value of $H_{cJ}$ is not obtained even if alloy powder particles of a specific size according to the present invention is used and the alloy powder particles of the specific size is used at a specific weight ratio according to the present invention with respect to the sintered R-T-B based magnet bodies.

Example 5

Nd metal, Pr metal, Dy metal, ferroboron alloy, electrolytic Co, Al metal, Cu metal, Ga metal and electrolytic iron (all the metals had a purity of 99% or greater) were combined to form the compositions of material No. A and material No. B in Table 1. A plurality of lots of sintered R-T-B based magnet bodies were prepared by the same method as in example 1. Next, Tb metal, Dy metal and electrolytic iron were combined to form the compositions of alloy powder particles Nos. w-1 through w-10 in Table 10. Alloys were produced by the same method as in example 1. The obtained alloys were pulverized by a pin mill and then screened with a sieve (conformed to JIS) having openings of 63 μm. As a result, a plurality of alloy powder particles having a size of 63 μm or less (alloy powder samples Nos. w-1 through w-10) were obtained. As stirring aid members, a plurality of zirconia balls having a diameter of 5 mm were prepared.

TABLE 10

| Alloy powder No. | Tb mass % | Dy mass % | Fe mass % |
|---|---|---|---|
| w-1 | 58.7 | 0 | 41.3 |
| w-2 | 48.7 | 0 | 51.3 |
| w-3 | 42.6 | 0 | 57.4 |
| w-4 | 36.2 | 0 | 63.8 |
| w-5 | 30.7 | 0 | 69.3 |
| w-6 | 0 | 59.3 | 40.7 |

TABLE 10-continued

| Alloy powder No. | Tb mass % | Dy mass % | Fe mass % |
|---|---|---|---|
| w-7 | 0 | 49.2 | 50.8 |
| w-8 | 0 | 43.2 | 56.8 |
| w-9 | 0 | 36.1 | 63.9 |
| w-10 | 0 | 30.1 | 69.9 |

Next, the plurality of alloy powder particles, one lot of the sintered R-T-B based magnet bodies, and the stirring aid members were loaded into the process chamber shown in FIG. 2 under the conditions shown in Table 11. The RH supply and diffusion process was performed under the same conditions as those in example 1. A heat treatment was performed by the same method as in example 1. The magnetic characteristics of the obtained sintered R-T-B based magnets were measured by the same method as in example 1. Table 11 shows the measurement results of samples Nos. 70 through 79. Sample No. 70 in Table 11 was obtained as a result of the RH supply and diffusion process performed on the alloy powder sample No. w-1 and sintered R-T-B based magnet bodies of material No. A. Samples Nos. 71 through 79 are shown in substantially the same manner.

TABLE 11

| Sample No. | Alloy powder No. | Material No. | Br [T] | HcJ [kA/m] | |
|---|---|---|---|---|---|
| 70 | w-1 | A | 1.40 | 1871 | Present invention |
| 71 | w-2 | A | 1.40 | 1903 | Present invention |
| 72 | w-3 | A | 1.40 | 1886 | Present invention |
| 73 | w-4 | A | 1.40 | 1851 | Present invention |
| 74 | w-5 | A | 1.40 | 1801 | Present invention |
| 75 | w-6 | B | 1.42 | 1624 | Present invention |
| 76 | w-7 | B | 1.42 | 1645 | Present invention |
| 77 | w-8 | B | 1.42 | 1634 | Present invention |
| 78 | w-9 | B | 1.42 | 1610 | Present invention |
| 79 | w-10 | B | 1.42 | 1576 | Present invention |

As shown in Table 11, regardless of whether Tb is contained or Dy is contained as the heavy rare earth element RH in the plurality of alloy powder particles, samples Nos. 70 through 73 and 75 through 78 using a plurality of alloy powder particles containing the heavy rare earth element RH at a content of 35 mass % or greater (samples Nos. 70 through 73 contain Tb (alloy powder samples Nos. w-1 through w-4) and samples Nos. 75 through 78 contain Dy (alloy powder samples Nos. w-6 through w-9)) have a higher value of $H_{cJ}$ than samples Nos. 74 and 79 using a plurality of alloy powder particles containing the heavy rare earth element RH at a content of less than 35 mass % (sample No. 74 contains Tb (alloy powder sample No. w-5) and sample No. 79 contains Dy (alloy powder sample No. w-10)). Samples Nos. 70 through 72 and 75 through 77 using the plurality of alloy powder particles containing the heavy rare earth element RH at a content of 40 mass % or greater and 60 mass % or less have a still higher value. As can be seen, the plurality of alloy powder particles preferably contain the heavy rare earth element RH at a content of 35 mass % or greater, and more preferably contain the heavy rare earth element RH at a content of 40 mass % or greater and 60 mass % or less.

Example 6

Nd metal, Pr metal, ferroboron alloy, electrolytic Co, Al metal, Cu metal, Ga metal and electrolytic iron (all the metals had a purity of 99% or greater) were combined to form the compositions of material No. C and material No. D shown in Table 12. Sintered R-T-B based magnet bodies were prepared by the same method as in example 1. Material No. C in Table 12 has the same composition as that of material No. A shown in Table 1. The components and the gas analysis results of the obtained sintered R-T-B based magnet bodies were equivalent to those of material No. C and material D in example 1.

TABLE 12

| Material | Analysis results of the sintered R-T-B based magnets (mass %) | | | | | | | | | | | |
|---|---|---|---|---|---|---|---|---|---|---|---|---|
| No. | Nd | Pr | Dy | B | Co | Al | Cu | Ga | Fe | O | N | C |
| C | 23.0 | 7.0 | 0.0 | 1.0 | 2.0 | 0.4 | 0.1 | 0.3 | bal. | 0.07 | 0.05 | 0.09 |
| D | 0.0 | 30.0 | 0.0 | 1.0 | 0.9 | 0.1 | 0.1 | 0.0 | bal. | 0.06 | 0.06 | 0.07 |

Next, Tb metal, Dy metal and electrolytic iron were combined to form the compositions of alloy powder samples Nos. x-1 through x-3 shown in Table 13, and subjected to hydrogen pulverization. As a result, a plurality of alloy powder particles were prepared. The hydrogen pulverization was performed as follows. Alloy powder samples Nos. x-1 through x-3 were loaded into a hydrogen furnace, and then hydrogen was started to be supplied to the hydrogen furnace at room temperature. The resultant substance was subjected to a hydrogen occlusion step, more specifically, the absolute pressure of hydrogen was kept at about 0.3 MPa for 90 minutes. In this step, as the hydrogen occlusion reaction of the alloy powder advances, hydrogen in the furnace is consumed and the pressure of hydrogen is decreased. Therefore, hydrogen was additionally supplied in order to compensate for the decrease so that the pressure was controlled to be about 0.3 MPa.

TABLE 13

| Alloy powder No. | Tb mass % | Dy mass % | Fe mass % |
|---|---|---|---|
| x-1 | 48.7 | 0 | 51.3 |
| x-2 | 36.2 | 0 | 63.8 |
| x-3 | 0 | 49.2 | 50.8 |

Next, the resultant substance was subjected to a dehydrogenation step, more specifically, the alloy powder particles were heated to each of the dehydrogenation temperatures shown in Table 14 for 8 hours in vacuum. The plurality of post-hydrogen pulverization alloy powder particles were heated in an Ar atmosphere, and the amount of hydrogen was measured by a melt column separation-thermal conductivity detection (TCD) method. Table 14 shows the measurement results. As stirring aid members, a plurality of zirconia balls having a diameter of 5 mm were prepared.

TABLE 14

| Sample No. | Alloy powder No. | Material No. | Dehydrogenation temperature (° C.) | Hydrogen amount (ppm) | Br [T] | HcJ [kA/m] | |
|---|---|---|---|---|---|---|---|
| 80 | x-1 | C | 350 | 775 | — | — | Comparative example |
| 81 | x-1 | C | 400 | 41 | 1.40 | 1898 | Present invention |
| 82 | x-1 | C | 500 | 35 | 1.39 | 1901 | Present invention |
| 83 | x-1 | C | 550 | 67 | 1.39 | 1913 | Present invention |
| 84 | x-1 | C | 600 | 255 | — | — | Comparative example |
| 85 | x-2 | C | 500 | 36 | 1.39 | 1849 | Present invention |
| 86 | x-3 | C | 400 | 40 | 1.40 | 1654 | Present invention |
| 87 | x-3 | C | 500 | 38 | 1.40 | 1656 | Present invention |
| 88 | x-3 | C | 550 | 32 | 1.40 | 1664 | Present invention |
| 89 | x-3 | C | 500 | 39 | 1.40 | 1669 | Present invention |

The plurality of post-hydrogen pulverization alloy powder particles not subjected to classification using a sieve having openings of 90 μm, the sintered R-T-B based magnet bodies, and the stirring aid members were loaded into the process chamber shown in FIG. 2. The RH supply and diffusion process was performed by the same method as in example 1. The weight ratio of the plurality of post-hydrogen pulverization alloy powder particles that were loaded into the process chamber was 3% with respect to the sintered R-T-B based magnet bodies in each of the samples. A heat treatment was performed by the same method as in example 1. For confirmation, the plurality of post-hydrogen pulverization alloy powder particles were screened with a sieve of 90 μm. In each of the samples, 90% by weight or greater of the plurality of alloy powder particles had a size of 90 μm or less.

Table 14 shows the measurement results of the magnetic characteristics of the obtained sintered R-T-B based magnets. In Table 14, the values of $B_r$ and $H_{cJ}$ were each obtained as follows. The post-heat treatment sintered R-T-B based magnets were mechanically processed, more specifically, were shaved at all the surfaces by 0.1 mm to obtain samples each having a size of 7 mm×7 mm×7 mm. The values of $B_r$ and $H_{cJ}$ were measured by a BH tracer. In Table 14, sample No. 80 was obtained as a result of the RH supply and diffusion process performed on alloy powder sample No. x-1 and sintered R-T-B based magnet bodies of material No. C. Samples Nos. 81 through 89 are shown in substantially the same manner.

According to the present invention, hydrogen pulverization of heating the alloy powder particles to a temperature of 400° C. or higher and 550° C. or lower in the dehydrogenation step (dehydrogenation temperature: 400° C. or higher and 550° C. or lower) was performed. As shown in Table 14, regardless of whether Tb is contained or Dy is contained as the heavy rare earth element RH in the plurality of alloy powder particles, the samples according to the present invention obtained as a result of the hydrogen pulverization (samples Nos. 81 through 83 and 85 through 89) have a high value of $H_{cJ}$. As can be seen from the samples Nos. 81 through 83 using the same alloy powder (alloy powder sample No. x-1), in the case where the dehydrogenation temperature is within the range according to the present invention, the value of $H_{cJ}$ is in the range of 1898 kA/m to 1913 kA/m. The value of $H_{cJ}$ does not change much, and a high value of $H_{cJ}$ is obtained stably. By contrast, in the case of the samples Nos. 80 and with the dehydrogenation temperature out of the range according to the present invention, the magnetic characteristics were not measured because hydrogen embrittlement occurred to the sintered R-T-B based magnets after the RH supply and diffusion process. As shown in Table 14, in the case of the plurality of alloy powder particles produced under the hydrogen pulverization conditions according to the present invention (samples Nos. 81 through 83 and 85 through 89), the amount of remaining hydrogen is several ten ppm, namely, almost zero. By contrast, in the case of the plurality of alloy powder particles with the dehydrogenation temperature out of the range according to the present invention (samples Nos. 80 and 84), the remaining amount of hydrogen is as large as several hundred ppm. It is considered from this that hydrogen was supplied from the plurality of alloy powder particles to the sintered R-T-B based magnet bodies during the RH supply and diffusion process, and as a result, hydrogen embrittlement occurred to the sintered R-T-B based magnets obtained as final products.

INDUSTRIAL APPLICABILITY

According to the present invention, a sintered R-T-B based magnet having a high level of remanence and a high level of coercivity is produced. A sintered magnet according to the present invention is preferable to various motors including hybrid vehicle-mountable motors exposed to high temperature, and the like, electric and electronic home appliances, and the like.

REFERENCE SIGNS LIST

1 Sintered R-T-B based magnet body
2 Alloy powder particle
3 Stirring aid member
4 Process chamber
5 Cap
6 Exhaust system
7 Heater
8 Motor

The invention claimed is:

1. A method for producing a sintered R-T-B based magnet, comprising the steps of:

providing a plurality of sintered R-T-B based magnet bodies (R is at least one of rare earth elements and necessarily contains Nd and/or Pr; and T is at least one of transition metals and necessarily contains Fe);

providing a plurality of alloy powder particles having a size of 90 μm or less and containing a heavy rare earth element RH (the heavy rare earth RH is Tb and/or Dy) at a content of 20 mass % or greater and 80 mass % or less;

loading the plurality of sintered R-T-B based magnet bodies and the plurality of alloy powder particles of a ratio of 2% by weight or greater and 15% by weight or less with respect to the plurality of sintered R-T-B based magnet bodies into a process chamber; and heating, while rotating and/or swinging, the process chamber to move the sintered R-T-B based magnet bodies and the alloy powder particles continuously or intermittently to perform an RH supply and diffusion process.

2. The method for producing a sintered R-T-B based magnet according to claim 1, wherein the plurality of sintered R-T-B based magnet bodies necessarily contain Nd.

3. The method for producing a sintered R-T-B based magnet according to claim 1, further comprising the step of loading a plurality of stirring aid members into the process chamber.

4. The method for producing a sintered R-T-B based magnet according to claim 3, wherein during the RH supply and diffusion process, only the plurality of sintered R-T-B based magnet bodies, the plurality of alloy powder particles and the plurality of stirring aid members are contained as solids in the process chamber.

5. The method for producing a sintered R-T-B based magnet according to claim 1, wherein the plurality of alloy powder particles each have a size of 38 μm or greater and 75 μm or less.

6. The method for producing a sintered R-T-B based magnet according to claim 5, wherein the plurality of alloy powder particles each have a size of 38 μm or greater and 63 μm or less.

7. The method for producing a sintered R-T-B based magnet according to claim 1, wherein the plurality of alloy powder particles is loaded into the process chamber at a ratio of 3% by weight or greater and 7% by weight or less with respect to the plurality of sintered R-T-B based magnet bodies.

8. The method for producing a sintered R-T-B based magnet according to claim 1, wherein the plurality of alloy powder particles at least partially contain alloy powder particles having a new surface exposed.

9. The method for producing a sintered R-T-B based magnet according to claim 1, wherein the plurality of alloy powder particles contain the heavy rare earth element RH at a content of 35 mass % or greater and 65 mass % or less.

10. The method for producing a sintered R-T-B based magnet according to claim 9, wherein the plurality of alloy powder particles contain the heavy rare earth element RH at a content of 40 mass % or greater and 60 mass % or less.

11. The method for producing a sintered R-T-B based magnet according to claim 1, wherein the heavy rare earth element RH is Tb.

12. The method for producing a sintered R-T-B based magnet according to claim 1, wherein the plurality of alloy powder particles are produced by performing hydrogen pulverization on an alloy containing a heavy rare earth element RH (the heavy rare earth element RH is Tb and/or Dy) at a content of 35 mass % or greater and 50 mass % or less; and in a dehydrogenation step of the hydrogen pulverization, the alloy is heated to a temperature of 400° C. or higher and 550° C. or lower.

* * * * *